United States Patent [19]

Chisholm

[11] 4,238,427

[45] Dec. 9, 1980

[54] ATOMIZATION OF MOLTEN METALS

[76] Inventor: Douglas S. Chisholm, R.F.D. 1-141-E, Kent, Conn. 06757

[21] Appl. No.: 27,601

[22] Filed: Apr. 5, 1979

[51] Int. Cl.[3] ..... B01J 2/04

[52] U.S. Cl. ..... 264/7; 264/10; 264/82

[58] Field of Search ..... 264/7, 10, 82

[56] References Cited

U.S. PATENT DOCUMENTS

| | | | |
|---|---|---|---|
| 2,048,651 | 7/1936 | Norton | 264/10 |
| 2,630,623 | 3/1953 | Chisholm et al. | 264/12 |
| 3,246,982 | 4/1966 | Moritz et al. | 264/7 |
| 3,313,608 | 4/1967 | Guyer et al. | 264/10 |
| 4,035,116 | 7/1977 | O'Brien et al. | 264/7 |

*Primary Examiner*—Donald E. Czaja
*Assistant Examiner*—James R. Hall
*Attorney, Agent, or Firm*—Cushman, Darby & Cushman

[57] ABSTRACT

A stream of molten metal from a supply is impinged upon an electrode while an electrical potential is impressed between the supply and the electrode. The zone of impingement becomes a stable electric arc in which the stream is atomized. A carrier gas intersects the spray and removes heat from the metal particles.

8 Claims, 1 Drawing Figure

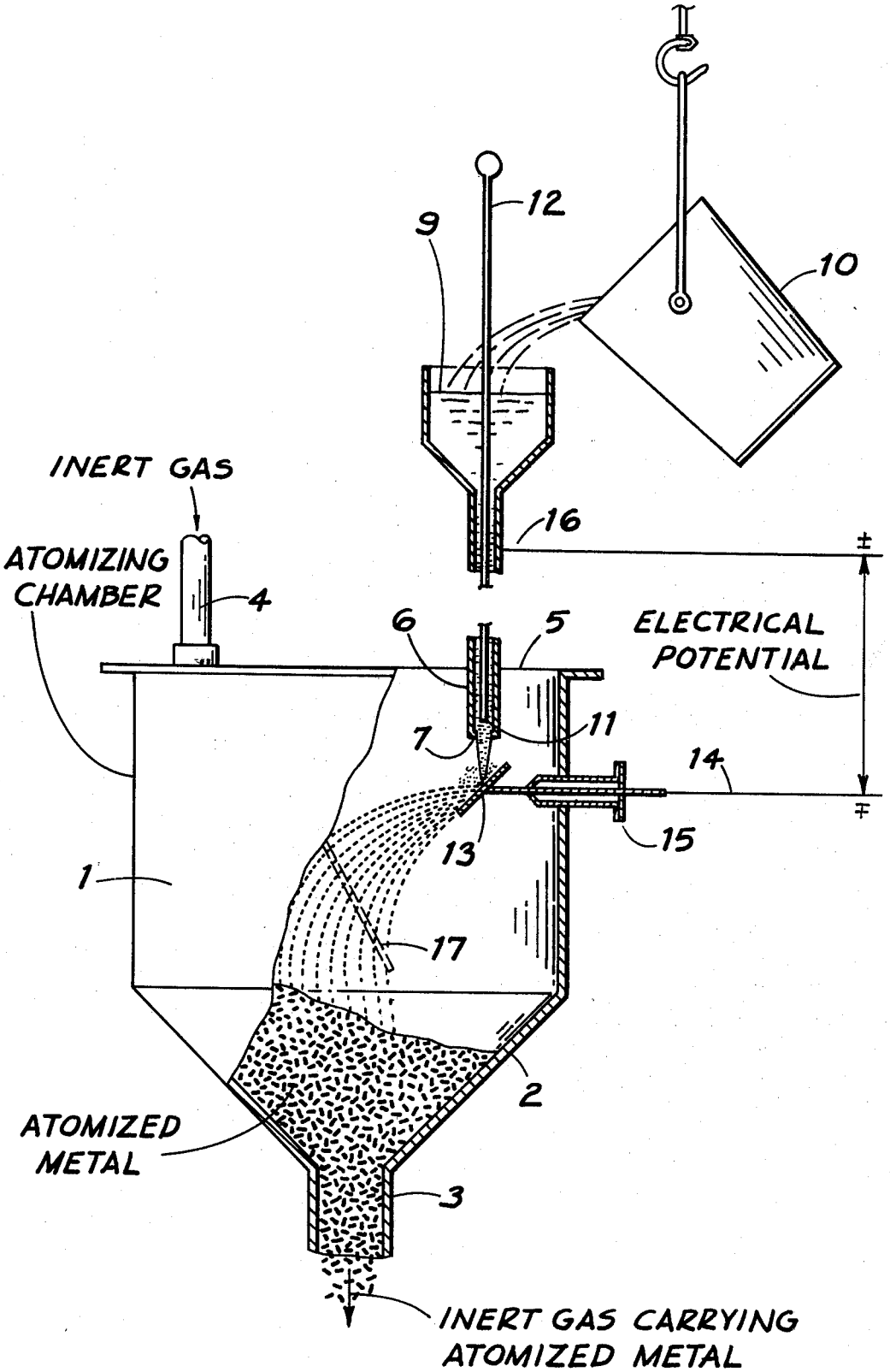
INERT GAS
ATOMIZING CHAMBER
4
9
12
10
16
±
ELECTRICAL POTENTIAL
6
5
7
11
14
∓
13
15
1
17
2
ATOMIZED METAL
3
INERT GAS CARRYING ATOMIZED METAL

ATOMIZATION OF MOLTEN METALS

BACKGROUND OF THE INVENTION

Atomization of molten metals is mainly accomplished by two methods: (1) jet atomization, wherein a stream of gas or liquid under high pressure impinges against a stream of the melt or (2) wheel or centrifugal atomization, in which the melt stream flows onto a rapidly rotating disc. Powders produced by either of these methods have a broad distribution of particle sizes. For most uses, it is the smaller sizes which have the greatest utility, necessitating sieving or other means of classification. The oversize is usually recycled, adding to the cost of the final product through melt and heat losses.

FIG. 1 of U.S. Pat. No. 2,630,623 depicts a conventional gas-atomizing process in which a jet of inert gas is impinged on a stream of molten metal in order to break it into droplets. FIG. 1 of U.S. Pat. No. 3,021,562 shows apparatus in which an electrical potential is maintained between a supply of solid metal and an electrode. A process and apparatus for the production of metal powder by atomization of a wire fed against a rotating, water-cooled, vibrating electrode are described by G. Matei, E. Bicsak, W. J. Huppmann and N. Claussen in "Atomization of Metal Powders Using the Vibrating Electrode Method", *Modern Der. in P/M,* Vol. 9, P/M Prin. and Prod. Proc., Hausner et al Eds., M/P Ind. Fed., A.M.P.I., Box 2054, Princeton, N.J. 08540.

SUMMARY OF THE INVENTION

The present invention provides a process for producing powdered metal by atomization of a molten metal stream, which is controllable to provide a desired size distribution of particles, and particularly to provide smaller size particles.

The present invention concerns a departure from the foregoing methods in that there is no high velocity jet of gas or liquid, nor a high-speed rotor. This invention is based on the discovery that when a stream of molten metal impinges on an electrode, and an electrical potential is impressed between the source of the stream and the electrode, the zone of impingement becomes a stable electric arc.

Particle size and size distribution are controlled by varying one or more of the following: (1) current density, (2) polarity and/or pulsation (if direct current is used), (3) frequency (if alternating current), and (4) imposed magnetic field.

The material of which the target electrode is made may be of the same composition as that being atomized. In this case it is then a consumable electrode, provision being made for advancing it along into the arc zone. Alternatively, if it is of a material other than the melt, it must have a much higher melting point and be insoluble in and unreactive with the melt.

The atomization is carried out in a chamber through which a carrier gas is passed for leading off heat from the atomized particles.

The principles of the invention will be further discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

In the Drawing

The figure is a somewhat schematic side elevational view of typical apparatus for conducting the process.

DETAILED DESCRIPTION

Referring to the drawing, there is shown provided an atomizing chamber 1 having a hopper bottom 2 provided with an outlet 3 through which an inert gas which enters the chamber at 4 carries the produced metal powder particles to a conventional separator. There, the particles are separated and removed through a lock chamber and the inert gas is cooled and recycled to the inlet 4.

The carrier gas may be a hydrocarbon gas, e.g. mineral oil fog which is desirable since it forms a coating on the metal powder rendering the metal less reactive when exposed to air. However, if the hydrocarbons are found to crack in the vicinity of the arc and produce too much carbon, some or all of the hydrocarbons in the carrier gas stream may be replaced by an inert gas such as argon or helium. Where a protective coating is needed and hydrocarbons cannot be used in the carrier gas stream, a small amount of $SF_6$ may be used, e.g. when the metal is magnesium, in the inert gas stream to provide the protective coating. With many metals that are less reactive in air than is magnesium, no coating constituent is needed in the carrier gas.

Projecting into the chamber 1 through the top 5 is the standpipe 6, the lower end of which is provided with a discharge orifice 7. The upper end of the standpipe carries a tundish into which the molten metal 9, to be atomized, is introduced as from the tilting ladle 10. The opening of the orifice 7 may be regulated by the tapered plug 11 which may be moved into or out of the orifice 7 by the control rod 12. Below the orifice 7 is arranged the electrode 13 which is mounted on rod 14 providing for positioning electrode 13 and electrical connection to it. Rod 14 passes through stuffing box 15 to the outside of chamber 1. The other electrical connection 16 is made to the molten metal through standpipe 6.

The electrode 13 need neither be rotated nor vibrated, although it could be. Preferably, the carrier gas stream is not jetted against the stream of molten metal and thus plays no substantial role in breaking the stream of molten metal into droplets.

The composition of electrode 13, if consumable, will depend upon the composition of the molten metal to be atomized, so as to be of the same composition, if a pure metal powder is desired, e.g. of magnesium to produce powdered magnesium, or if an alloy is desired or is acceptable then of a metal that will alloy with the molten metal. Purity of the powder produced from molten metal can also be assured by using for manufacture of the electrode 13 a material that will not alloy with the molten metal under the process conditions, e.g. using graphite or titanium for the electrode 13 when producing magnesium powder.

The present inventor has for demonstration purposes conducted the process using mercury as the molten metal, stainless steel for the electrode 13, twelve volts A.C. as the impressed voltage, and air as the carrier gas. It appeared that the voltage could be varied from about 10 to about 200 volts. Near the upper limit, the high current density would begin to cause too much of the metal to gasify. Of course, for a stream of larger cross section, the same impressed voltage would produce a lower current density so the voltage limits would need corresponding adjustment. The true limits appear to be that sufficient voltage must be impressed to establish and maintain an arc, but the current density must not be so great as to gasify too much of the molten metal. Production of some metal gas is considered very advantageous, as it disrupts the liquid stream and thus aids in atomization of the stream into droplets.

The throughput of carrier gas must be sufficient to remove enough latent heat and any super heat from the liquid metal droplets that when the droplets converge and pass to collection at 3 they are at least superficially solidified so as not to coalesce or sinter unacceptably together.

In place of alternating current, the impressed voltage may be D.C. of either polarity, either constant or pulsed. In using direct current, the electrocapillarity effect may aid the atomization.

The process of the invention is believed to be applicable to production of all metal powders known to be produceable by conventional atomization processes, as well as to production of powders from atomization of other electrically conductive melts, such as from molten electrically conductive salts. The metallic melts need not be of pure metals, since metal alloy powder may be produced in this same way, from molten metal solutions which form alloys.

The drawing figure shows a presently desired disposition of the apparatus for carrying out the process, in which the electrode 13 is set at an oblique angle to one side of the chamber 1, so that the spray resulting upon atomization has the bulk of the volume of the chamber to fall through and so that the carrier gas stream has a chance for efficient contact with the falling droplets after their production, without being jetted against the electrode-impinging stream of liquid metal.

Instead of or in addition to use of a carrier gas for cooling the spray of metal droplets to solidify them, the present invention may make use of a splat cooling technique, in which a cooled surface member 17 is positioned on the path of the spray. The droplets, which approach the cooled surface member having a generally spherical shape, are flattened and solidified in a flattened condition due to momentarily impacting the cooled surface member 17. The cooled surface member 17 may be, for instance, a hollow plate through which cooling water is circulated. Its surface and its spatial placement relative to the spray should be such as to discourage accretion of splats thereon. Mechanical means such as a periodically traversing scraper may be used, if needed, to remove accretion and prevent its buildup.

It should now be apparent that the atomization of molten metals as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A process for producing a powdered metallic solid from a supply of electrically conductive molten liquid metallic material, comprising:

directing a stream of said electrically conductive molten liquid metallic material from the supply to impinge upon an electrode;

establishing and maintaining an electrical potential between said electrode and said supply sufficient to strike and maintain an electric arc in said stream in the vicinity of said electrode and sufficient to produce a metallic gas in the vicinity of said electrode, whereby, due to said electric arc and a disruptive effect of said metallic gas, said stream in the vicinity of said electrode is atomized into discrete droplets of molten metallic liquid; and contacting said discrete droplets with sufficient cooling fluid medium to at least superficially solidify said discrete droplets into metallic powder particles.

2. The process of claim 1, wherein:

said molten liquid material is magnesium.

3. The process of claim 1, wherein:

said electrode is disposed directly below said supply and said stream falls under the influence of gravity from said supply to impinge upon said electrode.

4. The process of claim 1, wherein:

the cooling fluid medium is a hydrocarbon gas.

5. The process of claim 1, wherein:

the cooling fluid medium is an inert gas selected from argon and helium.

6. The process of claim 1, further including:

coating each powder particle with a protective coating from said cooling fluid medium during said contacting step, in order to make the powder particles superficially less reactive in air.

7. A process for producing a powdered metallic solid from a supply of electrically conductive molten liquid metallic material, comprising:

directing a stream of said electrically conductive molten liquid metallic material from the supply to impinge upon an electrode;

establishing and maintaining an electrical potential between said electrode and said supply sufficient to strike and maintain an electric arc in said stream in the vicinity of said electrode and sufficient to produce a metallic gas in the vicinity of said electrode, whereby, due to said electric arc and a disruptive effect of said metallic gas, said stream in the vicinity of said electrode is atomized into discrete droplets of molten metallic liquid; and contacting said discrete droplets with cooling means to at least superficially solidify said discrete droplets into metallic powder particles.

8. The process of claim 7, wherein:

said discrete droplets of molten liquid travels along a path as a result of the atomization; and the contacting step is accomplished at least in part by intercepting said path with a cooled surface against which said discrete droplets travelling along said path impact, and are thereby splat-cooled to produce relatively flat powder particles.

* * * * *